United States Patent [19]

Peacock

[11] 4,100,997

[45] Jul. 18, 1978

[54] STEP CONSTRUCTION EMPLOYING INSERTABLE FASTENER HAVING DEFORMABLE PROJECTIONS

[76] Inventor: Bobbie D. Peacock, 702 Hippocket Rd., Peachtree City, Ga. 30269

[21] Appl. No.: 698,490

[22] Filed: Jun. 21, 1976

[51] Int. Cl.[2] ..... E04F 19/00

[52] U.S. Cl. ..... 182/90

[58] Field of Search ..... 85/DIG. 2, 21, 23, 24, 85/25; 182/90

[56] References Cited

U.S. PATENT DOCUMENTS

| | | | |
|---|---|---|---|
| 2,064,803 | 12/1936 | Grove | 182/90 |
| 2,650,032 | 8/1953 | Godfrey | 85/23 |
| 3,867,864 | 2/1975 | Knohl | 85/21 |

FOREIGN PATENT DOCUMENTS

| | | | |
|---|---|---|---|
| 551,003 | 9/1956 | Belgium | 85/21 |
| 2,254,550 | 5/1973 | Fed. Rep. of Germany | 182/90 |
| 198,694 | 7/1938 | Switzerland | 85/21 |
| 916,048 | 1/1963 | United Kingdom | 85/21 |

*Primary Examiner*—Ernest R. Purser
*Assistant Examiner*—Carl D. Friedman
*Attorney, Agent, or Firm*—Patrick F. Henry

[57] ABSTRACT

A molded plastic fastener of the sort which may be used as part of steps for a concrete manhole has molded plastic, circular threads or projections which are tapered and deformable so that when inserted in a drilled hole of slightly smaller diameter the projections will be deformed and bend under pressure to retain the fastener in place.

1 Claim, 3 Drawing Figures

STEP CONSTRUCTION EMPLOYING INSERTABLE FASTENER HAVING DEFORMABLE PROJECTIONS

BACKGROUND OF THE INVENTION

1. Field of the Invention

Supports and fasteners, especially anchoring devices having deformable projections or threads to fit smaller or tapered openings.

2. Description of the Prior Art

The prior art includes a substantial number of expansion anchors studs, concrete anchoring devices and other similar means providing a rigid device by means of which something may be attached to concrete. However, such devices are generally made from metal or at least a combination of metal and some other material such as rubber, wood or plastic and accordingly require some amount of preparatory work plus the fact that metal tends to deteriorate rapidly in humid or moist conditions like that found underground in manhole installations unless of course expensive metal such as stainless steel is used. The present concrete anchoring device may be used as the tips of a plastic molded step which is easily hammered into a tapered opening in a concrete manhole and will remain that way for a long period of time.

SUMMARY OF THE INVENTION

A molded plastic step having an elongated step member and a pair of projecting support members each being provided with projecting molded threads which deform when the ends are forced into a slightly tapered opening or an opening of slightly less diameter than the overall diameter of the projections.

Other and further objects and advantages of the present invention will become apparent upon reading the following description of a preferred embodiment taken in conjunction with the accompanying drawings.

DESCRIPTION OF A PREFERRED EMBODIMENT

Figure 1:
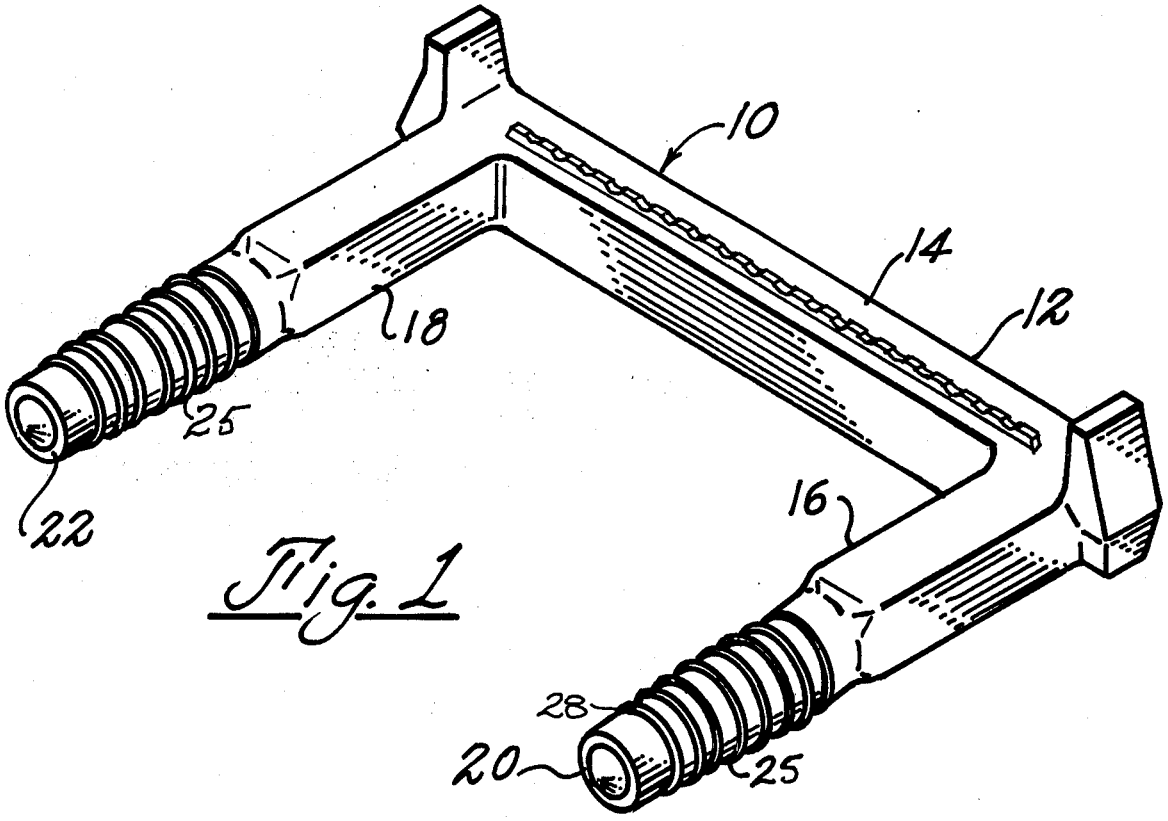
FIG. 1 is a perspective view of a molded plastic step made in accordance with the present invention.
Figure 2:
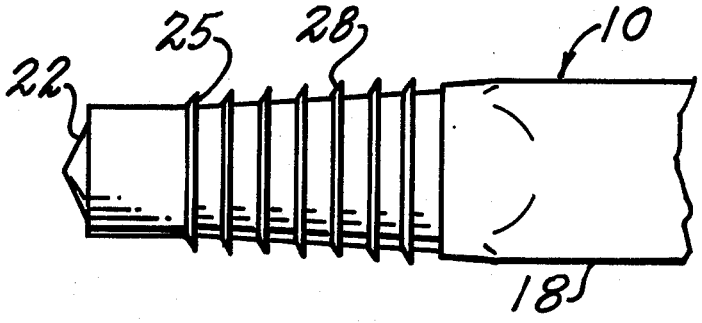
FIG. 2 is a side elevation view of the tip or end of one of the support members of the step shown in FIG. 1.

In FIG. 1 there is shown a molded plastic step designated generally by reference numeral 10 and which is molded from plastic material such as polypropylene or other well known plastic material and as an integrally formed step having a step member 12 with an upper flat step surface 14 and respective opposed, step support members 16, 18 extending substantially 90° from the step member 12. Each end 20, 22 of the respective members 16, 18 is provided with a particular configuration which constitutes a means for retaining each member 16, 18 and the entire step 10 in place in concrete 24 by means of projections 25 in a tapered hole or bore 26 shown in cross-section in FIG. 3. The tapered opening or bore 26 is made by a drill or any other suitable means. Each end 20, 22 is identical in construction and is molded to include the plurality of identical, spaced circular projections 25 which may be smaller or less in diameter from one another beginning with the endmost one leading toward the step member 12. Likewise, the end of the step 10 at 20, 22 may be tapered slightly. Each projecting member 25 is tapered in a direction away from the respective ends 20, 22 to provide a slanted or beveled face 28.

Figure 3:
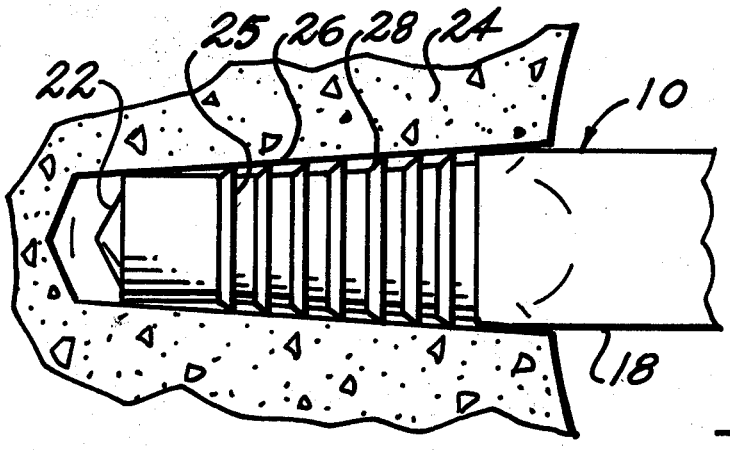
FIG. 3 is a cross-sectional view showing concrete in section and one of thetips of the step in full lines after insertion.

Accordingly, when the ends 20, 22 are aligned with the respective opening 26 in the concrete 24 and then hammered in place by a mallet or small sledge hammer the projecting members 25 are caused to deform in the manner shown in FIG. 3 and to be forced under pressure into the opening 26. Thus, the resilient and deformable projecting members 25 are under pressure holding the ends 20, 22 rigidly in place in the respective opening 26.

A plurality of steps 10 are installed one above, or below as the case may be, the other by drilling respective holes 26 to accomodate the ends 20, 22 driven into place. Steps 10 may be installed in this manner in a wall or concrete manhole without the use of expansion plugs or anchors.

While I have shown and described a particular embodiment of this invention this is by way of illustration only and does not constitute any sort of limitation on the scope of the invention since various alterations, changes, deviations, eliminations, revisions and departures may be made in the embodiment shown and described without departing from the scope of the invention as defined only by a proper interpretation of the appended claims.

What is claimed is:

1. In an integrally molded prefabricated step for insertion in a pair of spaced tapered holes drilled or otherwise formed in a solid material such as concrete:

an elongated step member having a pair of outwardly projecting support members integrally molded thereon and rigidly attached substantially at right angles thereto, each of the ends of said support members being tapered for insertion into the corresponding tapered holes and having individual substantially arcuate and continuous resilient projections integrally molded thereon from plastic material and the like and each of said projections having a slanted face inclined toward the step member and including a marginal edge which is deformable under pressure whereby when said end is driven into a respective opening of less distance than the overall distance between the marginal edges of the projections the projections are deformed and the step is held in place, said deformable members being substantially circular and being progressively larger in diameter from the external terminal end toward the step whereby said respective ends may be aligned with a respective spaced hole and driven into a tapered hole to support said step and to seal the respective holes.

* * * * *